US006066789A

United States Patent [19]

Lisi

[11] Patent Number: 6,066,789

[45] Date of Patent: May 23, 2000

[54] DEVICE FOR GUITAR WEIGHT AND TONE ADJUSTMENT

[76] Inventor: James M. Lisi, P.O. Box 391038, Cambridge, Mass. 02139-0011

[21] Appl. No.: 08/990,604

[22] Filed: Dec. 15, 1997

[51] Int. Cl.[7] ..... G10D 1/08

[52] U.S. Cl. ..... 84/267; 84/291

[58] Field of Search ..... 84/267, 290, 291, 84/453

[56] References Cited

U.S. PATENT DOCUMENTS

| | | | |
|---|---|---|---|
| D. 278,541 | 4/1985 | Toth | D17/14 |
| 1,343,164 | 6/1920 | Smith | 84/411 R |
| 4,149,442 | 4/1979 | Boshco | 84/1.15 |
| 4,351,217 | 9/1982 | Wechter | 84/1.16 |
| 4,538,497 | 9/1985 | Smith | 84/291 |
| 4,635,522 | 1/1987 | Excellente | 84/291 |
| 4,829,870 | 5/1989 | Ralston | 84/291 |
| 4,919,029 | 4/1990 | Excellente | 84/291 |
| 5,549,026 | 8/1996 | Gay, Jr. | 84/292 |

*Primary Examiner*—Jonathan Salata
*Assistant Examiner*—Marlon T. Fletcher

[57] ABSTRACT

Device for Guitar Weight and Tone Adjustment is made of lead sheets sandwiched between two brass plates screwed into the back of electric guitars, designed to affect their tone by varying the mass according to the player's specifications.

1 Claim, 2 Drawing Sheets

DEVICE FOR GUITAR WEIGHT AND TONE ADJUSTMENT

BACKGROUND OF THE INVENTION

TECHNICAL FIELD

Figure 1:
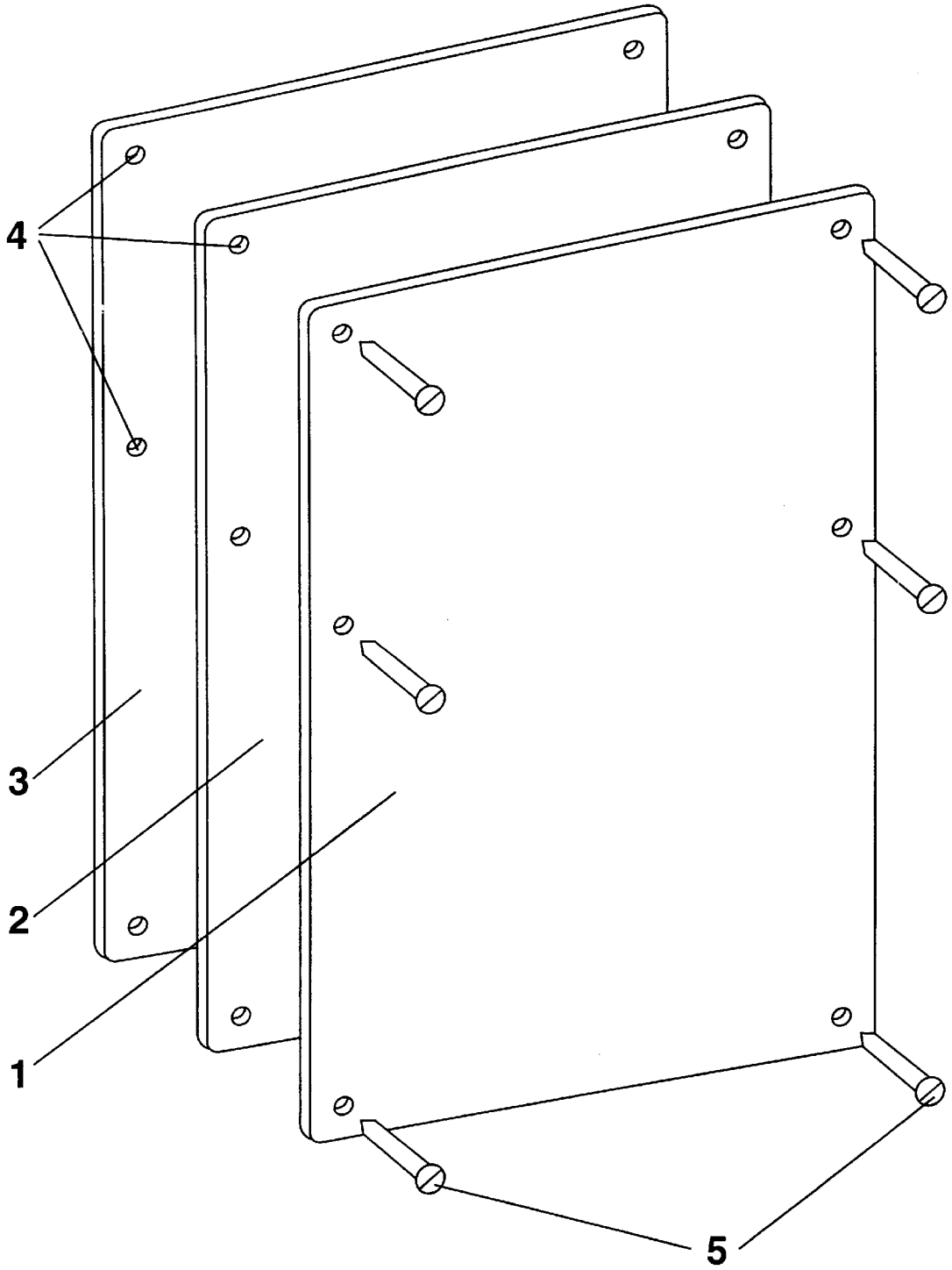
Figure 2:
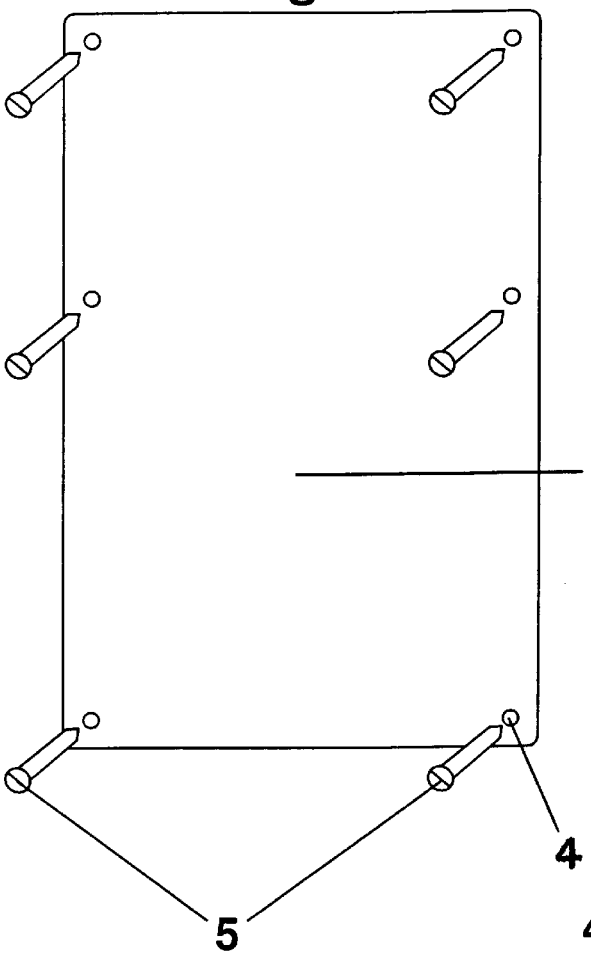
Figure 3:
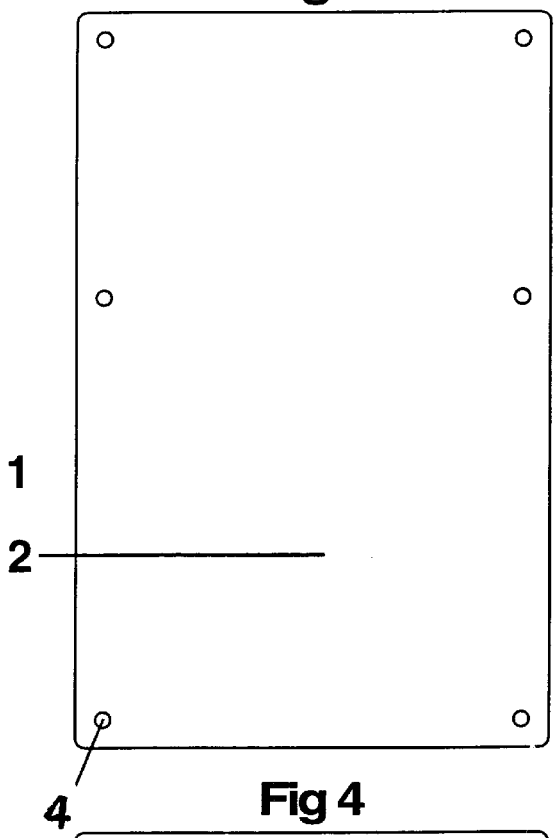
Figure 4:
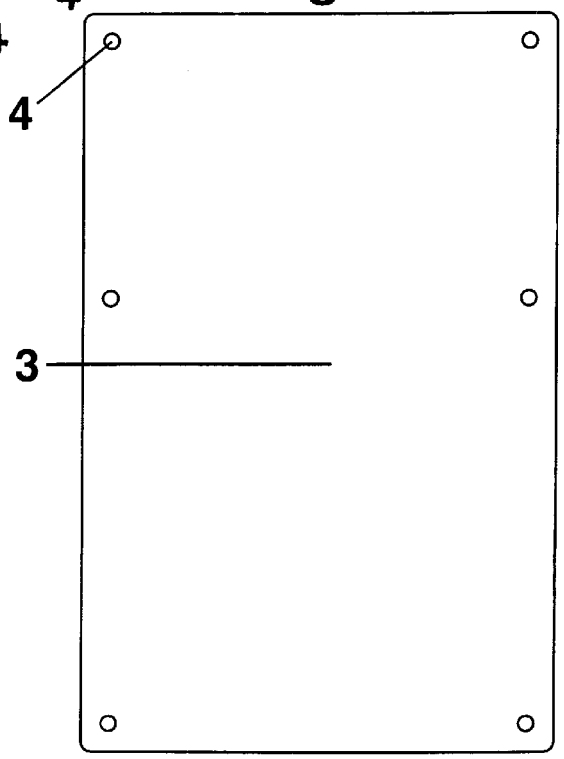

This invention relates to a device designed to add weight and improve tone when attached to a stringed musical instrument, particularly electric guitars.

BACKGROUND ART

Commercially manufactured guitars are designed using a variety of raw materials. One of the major factors in determining the weight and tonal qualities of an electric guitar is the material used to manufacture the body of the instrument.

Although some instruments make use of metal or plastic, most guitar bodies are made of wood. An assortment of different types of wood are ;used. Depending on the particular type of wood used, guitars vary in weight and tone. For example, alder and ash are dense woods, allowing for heavier guitars with more sustain and desirable tone quality. Whereas less expensive guitars made from poplar or other less dense woods are generally lighter, having less sustain and less desirable tonal qualities.

It is also noted that the individual guitar player's requirements of tone and weight differ from player to player. This invention offers a technique of adjusting the mass of any electric guitar, particularly inexpensive lightweight guitars having poor sustaining and tonal qualities, to suit the requirements of individual players.

It is also noted that in today's world, the supply of high quality tone woods has been and is becoming more limited, putting these quality instruments out of reach of some players. By the attachment of this inexpensive device to old or new guitars, weight and tone adjustment can be made and changed quickly to suit the parameters of an individual player.

Excellente U.S. Pat. No. 4,635,522 shows that by building a guitar with a unisymmetrical mass loading, providing more mass to the side of the guitar's high frequency strings, the tone of the guitar can be balanced. This differs from the Device for Guitar Weight and Tone Adjustment in that the example set forth by Excellente is an actual guitar design, not an easily adjustable device which simply attaches and detaches to any electric guitar.

Excellente U.S. Pat. No. 4,919,029 again shows that by adding mass to a guitar, the tonal qualities may be changed. However, Excellente's example is not a calibratible device, easily adjusted to allow the musician a variation of tonal effects by quickly adding or subtracting metal plates.

Ralston U.S. Pat. No. 4,829,870 again shows that by constructing a guitar with metal plates, sustain and tone can be enhanced. Again, unlike the Device for Guitar Weight and Tone Adjustment, Ralston's invention is an actual electric guitar, not a device for quickly adjusting the mass of an already existing electric guitar.

Wechter, U.S. Pat. No. 4,351,217 while providing a laminated removable tailblock, the device is designed to give access to the interior and provide a technique of adding electronic components to an acoustical guitar, and is by no means a technique of adding mass to an electric, solid body guitar in order to enhance tone and sustain.

Toth, Pat. No. Des. 278,541 makes use of a panel on the rear of their electric guitar; this panel is an ornament to provide access to the interior of the guitar. This ornamental guitar design does not provide a technique of quickly adjusting the mass of any electric guitar.

Smith, U.S. Pat. No. 4,538,497 soft body guitar makes use of a permanently affixed density plate; while this technology is similar to the technology incorporated by the Device for Guitar Weight and Tone Adjustment, but Smith's invention does not provide a technique or device for quickly adjusting the mass on any electric guitar.

Gay, Jr. U.S. Pat. No. 5,549,026 stringed musical instrument is a guitar design where the body of the guitar is made of metal, not a plurality of metal plates. Gay, Jr.'s design makes use of metal plates to secure the neck to the body of the guitar; Gay, Jr. also uses metal plates as covers, but again does not provide a technique of adjusting any electric guitar's mass to the varied specifications of individual guitar players.

Boshco U.S. Pat. No. 4,149,442 is a design for a metal surfaced electric guitar, again showing that tone may be affected by building a guitar with a metal surface. However, Boshco's design is not adjustable, it is a guitar with a fixed mass, not allowing the individual guitar player a technique of quickly adjusting the mass to suit an individual player's needs of tone and weight variations.

BRIEF SUMMARY OF THE INVENTION

The invention is constructed by sandwiching one or more lead panels in this embodiment measuring 3 ½"×5 ½"×1/20" between two brass panels measuring the same.

The purpose achieved by this device when attached to the rear of a solid body electric guitar is to increase the total mass of said electric guitar, thus making the guitar heavier to improve the tonal qualities of said instrument. The device being quickly adjustable by adding or subtracting lead panels.

Adjustments can actually be made to the device quickly during a live performance of the instrument.

This device also reduces unwanted vibrations of an electric guitar when firmly attached to said instrument.

The invention also provides shielding, blocking out unwanted radio frequencies.

What is claimed is:

1. A device for adjusting the weight and tone of an electric guitar is comprised of a plurality of metal panels including a front panel, at least one middle panel and a back panel; wherein the plurality of metal panels are attached to a back surface of an electric guitar by a plurality of screws such that the back panel is disposed on and in contact with the back surface of the electric guitar the at least one middle panel is disposed between the front panel and the back panel wherein the front panel and the back panel are comprised of brass and the at least one middle panel is comprised of lead.

* * * * *